United States Patent [19]

Legleiter

[11] 4,244,403

[45] Jan. 13, 1981

[54] APPARATUS FOR TRANSFERRING LIQUID BETWEEN A RESERVOIR AND A MOBILE TANK TRUCK

[76] Inventor: Paul P. Legleiter, P.O. Box 920, Gaylord, Mich. 49735

[21] Appl. No.: 30,728

[22] Filed: Apr. 17, 1979

[51] Int. Cl.[3] ..... B65B 3/04

[52] U.S. Cl. ..... 141/94; 141/98; 141/113; 141/198; 141/59; 222/52; 222/192

[58] Field of Search ..... 137/390; 141/1-11, 141/84, 102, 105, 100, 115, 128, 192-198, 206, 217, 220, 311 A, 392, 37-66, 113, 94, 95, 59, 98; 417/4 D, 33; 220/85 VS, 85 VR; 222/52, 192

[56] References Cited

U.S. PATENT DOCUMENTS

| | | | |
|---|---|---|---|
| 4,007,765 | 2/1977 | Bellows | 141/198 |
| 4,091,846 | 5/1978 | Legleiter | 141/198 |

*Primary Examiner*—Houston S. Bell, Jr.
*Attorney, Agent, or Firm*—Learman & McCulloch

[57] ABSTRACT

Liquid is transferred between a reservoir and a truck tank by means of a pump which pumps the liquid through a conduit leading to the tank and separably couples to the reservoir. An air opened, normally mechanically closed valve connecting the tank with the pump is operated when the pump is operated to permit flow between the tank and reservoir. The pump is operated by control mechanism that is operable to enable and disable its operation. It is connected to an energy source via a multiple position switching device which disables operation of the pump when the level of fluid in the tank reaches a predetermined height, and at the same time permits the safety valve to close. In another position of the switching means, the pump is rendered operable regardless of the fluid level in the tank and the valve will at that time also be open regardless of the fluid level in the tank. A system is disclosed in which both loading and unloading operations can be carried out with an electrical control system which prevents spill and the accumulation of dangerous vapors.

12 Claims, 5 Drawing Figures

APPARATUS FOR TRANSFERRING LIQUID BETWEEN A RESERVOIR AND A MOBILE TANK TRUCK

BACKGROUND OF THE INVENTION

The invention disclosed herein relates to apparatus and methods for transferring liquid such as crude oil between a reservoir and a tank truck. The present application is related to improvements in systems disclosed in the present patentee's U.S. Pat. No. 4,091,846.

The system described in my aforementioned patent, was designed to prevent crude oil or like liquids from contaminating the ground as a necessary adjunct to the loading operation. The present system accomplishes the same purpose and incorporates further improvements concerned with safe automatic operation of the so-called fire and vapor valves, while at the same time incorporating also unloading control functions.

One of the prime objects of the present invention is to safely systemize the unloading as well as the loading function in a manner to prevent contamination at the loading and unloading stations.

Another prime object of the invention is to provide a system which accomplishes this while providing for the automatic operation of fire and vapor vent valves in a manner which preserves the safety attributes of the system. By eliminating manual operation of these valves, the possibility of human inadvertence and human error is obviated and the dangers inherent in the transporting of vaporous and flammable liquids such as crude oil are greatly minimized.

SUMMARY OF THE INVENTION

A transport vehicle powered control system provides a pump for loading and unloading purposes. One embodiment of the invention permits bypass of the pump to permit gravity unloading to an underground storage reservoir. When loading, the pump is selectively controlled by a liquid level sensor which can, however, be overriden by a selective adjustment of the switch to permit emptying of the conduits supplying the oil or like liquid to space which is left in the very top of the tank. Fire and vapor valves are connected to automatically open when the pump is in operation to load, or when the pump is reversed to unload to above ground storage units. When gravity loading is to be accomplished a sensor, provided in the underground storage unit, is connected in the truck powered circuit and operates to open both the fire valve or valves (to permit gravity unloading) and the vapor release valve or valves.

Apparatus and methods according to the invention are illustrated in the accompanying drawings wherein.

Figure 1:
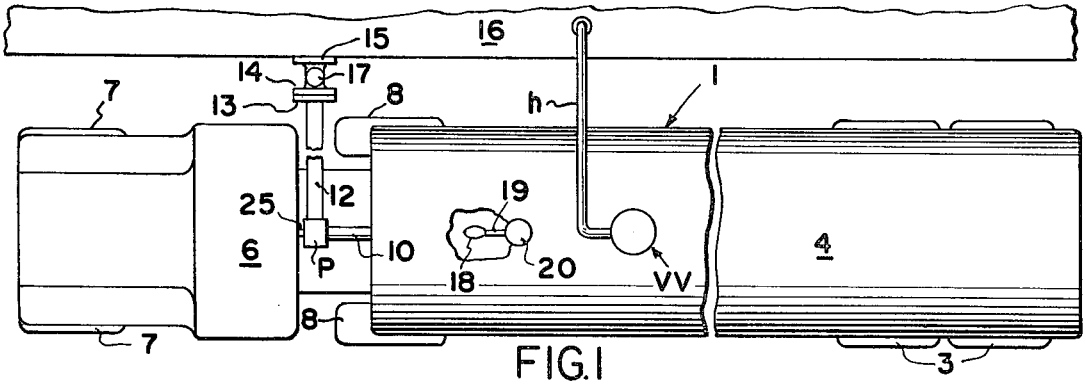
FIG. 1 is a top plan view schematically illustrating the tank, the reservoir, and some of the components for transferring liquid.
Figure 2:
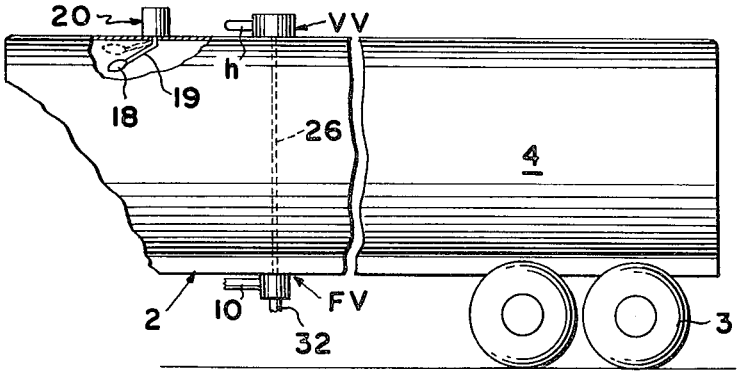
FIG. 2 is a fragmentary, side elevational view of the vehicular tank only, illustrating the float sensor which is employed.

Apparatus constructed in accordance with the invention is adapted for use with a conventional tank trailer 1, having a chassis 2 provided with wheels 3 and a cylindrically or other shaped tank 4 which is to contain a liquid such as crude oil to be transported from one location to another.

The trailer 1 may be removably coupled to a tractor 6 by a conventional fifth wheel construction (not shown), the tractor 6 having a chassis provided with steerable wheels 7 and driving wheels 8.

A vehicle of this character is conventionally provided with a liquid pump P which is in communication with the tank 4 by means of conduit 10. The other side of the pump P is coupled to one end of a conduit 12 which is provided with a quick coupling device 13, adapted to be removably connected to a fitting 14 provided at the outer end of a discharge pipe 15 which leads from the interior of a liquid storage reservoir 16. A valve 17, forming part of the fitting is operable to enable and prevent liquid from moving through conduit 12 and may be any one of a number of conventional couplings which are equipped with mechanism for enabling air to enter the conduit 12 when desired. Typical of such couplings are those disclosed in U.S. Pat. Nos. 2,033,142 and 2,518,026.

Figure 3:
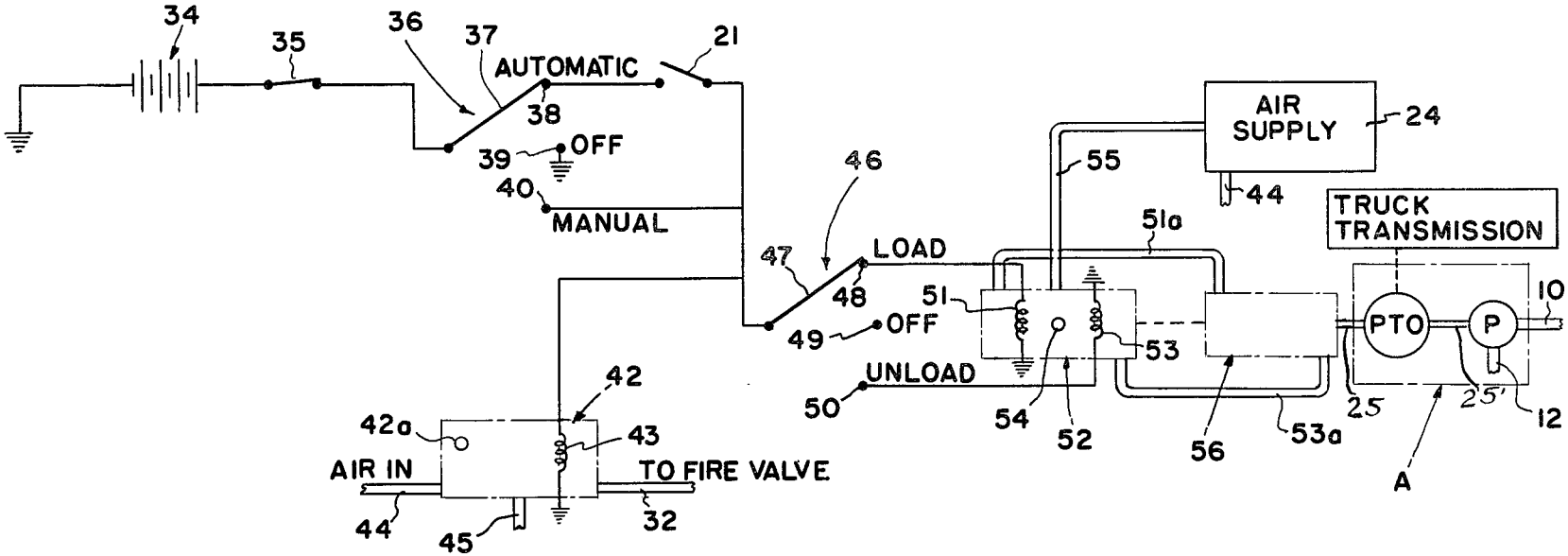
FIG. 3 is a schematic electrical diagram illustrating one embodiment of the invention.

Provided within the tank 4, near the upper end thereof, is a float sensor 18, mounted at one end of an arm 19, the opposite end of which extends through the wall of the tank into a housing 20 within which is an electrical switch 21 shown in the circuit diagram, FIG. 3. The float 18 rises and falls in accordance with corresponding changes in the level of liquid in the tank 4 and the switch 21 is closed by the arm 19 when the float is at a level lower than a predetermined, higher level. Movement of the float to the predetermined higher level effects opening of the switch 21, which may be any one of a number of known explosion proof switches. Vehicles designed for the purpose of transporting oil and like liquids, are normally provided with an air supply in the form of an on-board air compressor 24, and as will become apparent, it is air which is utilized to control the novel loading and unloading operation now to be described.

The pump P is part of a power take off and pump assembly A which includes also a transmission connected power take off device (PTO) such as the commercially available gear box manufactured by Dana Corporation of Chelsea, Michigan. An axially movable control rod or shaft 25 shifts the gears in the PTO box to drive gear box output shaft 25' and pump P in a direction to cause pump P to pump liquid in either a forward or rearward direction dependent on the axial position of rod 25. The rod 25 also has an axially intermediate neutral position to which it is automatically spring returned. In this neutral position of rod 25 the transmission drive is not connected to drive pump P.

Figure 4:
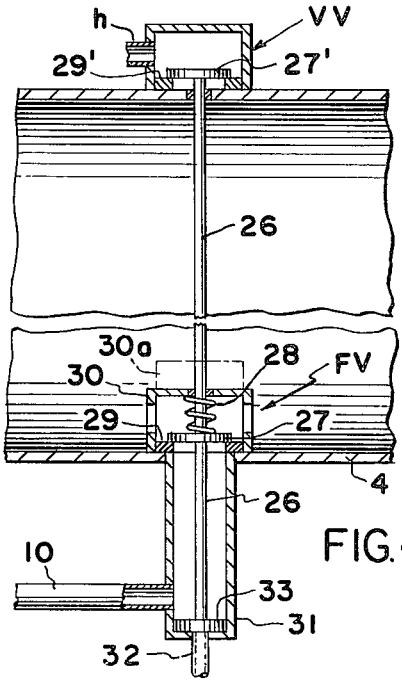
FIG. 4 is a fragmentary, sectional, side elevational view illustrating diagrammatically a "fire" valve which is provided in the inlet conduit to the vehicular tank.

When loading oil to the tank 4, the pump P will pump oil through the conduit 10 and through a normally closed fire valve construction, generally designated FV (see FIG. 4). The fire valve construction includes a valve stem 26, having a valve 27 normally urged by a spring 28 to seat on a valve seat 29 provided on the interior of tank 4 and close off the conduit 10. The housing 30 maintains spring 28 in a state of compression. At its lower end, the fire valve construction includes a boot end 31 to which a valve operating air line 32 is connected and the lower end of stem 26 includes a piston-like member 33 which is acted upon by air in line 32 to move valve 27 upwardly against spring 28 to an open position.

Turning now to a detailed description of the circuit illustrated in FIG. 3, which can be employed to either load or unload the trailer tank 4, it will be seen that a power source 34 is provided in the form of the truck battery. The switch 35 may be the vehicle's ignition switch. A three-way toggle switch, generally designated 36, has an operating arm 37 which is engageable with any one of three contacts 38, 39, and 40, which designate automatic position, off position, and manual position contacts. The float control switch 21, is located in the contact 38 circuit line.

Connected in parallel with this line and the contact 40 manual override line, is a conventional solenoid operated air valve 42, which is controlled by solenoid 43. Air is supplied to the valve 42 from the air supply 24 via a line 44, and the air line 32 leading to fire valve FV can extend from the opposite end of the valve 42. Also provided for a purpose which later will be described, is an exhaust 45 for the valve 42. As will later appear, when solenoid 43 is deenergized, conventional spring returned valve 42 operates to bleed air from the exhaust 45, and in this condition of valve 42, spring 28 maintains the fire valve stem 26 in the down, closed position. When solenoid 43 is energized, air valve 42 supplies air pressure through the line 32 to open valve 27. Valve 42 can be a commercially available valve manufactured by Peter Paul Electronic Company, Inc. of New Britain, Connecticut, and is of a type which can be manually overridden by twisting a knob **42*a* to communicate a supply of air through line 32 to open the fire valve FV when it is desired to do so. Valves of this character, can again be turned back to control by solenoid 43 by returning the knob 42*a*** to original position.

Provided in series with the three-way switch 36, is a second three-way toggle switch 46 which similarily includes an operating toggle arm 47, which in this instance is engageable with any one of three contacts 48, 49, and 50. Toggle switch 46 is, like switch 36, adjustable to any selected one of three positions which, however, in this instance are denominated "load", "off", and "unload". The contact 48 is in series with a solenoid 51, provided in a conventional solenoid operated air valve 52, which also has a solenoid 53 in series with the unload contact 50. Valve 52 also includes an exhaust port 54 and is supplied with air via line 55 from the air supply 24. The valve 52 can be a commercially available valve manufactured by Peter Paul Electronics Company, Inc. of New Britain, Connecticult. Valve 52 is provided to supply operating air via line **51*a* or line 53*a* to a conventional three-position air operated valve, generally designated 56, which controls the position of pump control rod 25. The valve 56** may be a commercially available valve such as the valve manufactured by Air Power Systems Company, Tulsa, Oklahoma.

It is to be understood that the fire valve FV is mechanically connected to the vapor valve VV provided in the top of tank 4 in the usual manner, and that the vapor valve hose h is connected to the upper end of reservoir 16. Thus, when the fire valve FV is opened, the vapor valve also mechanically opens and vapor driven off when the tank is being filled is driven into the upper end of the reservoir 16. The mechanical connection may simply comprise the continuation of rod 26 which includes a valve 27' which raises off its seat and admits vapor to hose h.

In operation, when it is desired to load crude oil from the reservoir 16 to the tank trailer 4 and the tank trailer 4 is in position to receive it, the operator connects removable conduit 12 (which he usually carries on the transport vehicle) to the coupling 14. He then switches arm 37 to the automatic position in which it is in contact with contact 38, and switches arm 47 to the "load" position at contact 48. At this time, sensor float switch 21 is in closed position, and solenoid 43 is energized so that air is supplied through conduit 32 to open fire valve FV. Similarly, selector arm 47 is in contact with contact 48 and solenoid 51 is energized to advance air through line **51*a* to valve 56, while exhausting air via line 53*a*, to move control arm 25 axially from neutral position to a position in which the pump forwards oil through the supply conduit 10. With the truck motor running, and ignition switch 35 closed, the operator can open the reservoir valve 17 to permit oil to be supplied through conduit 12 to the pump P, and on to the transport tank 4**.

As the level of liquid in the tank 4 rises, the float 18 also will rise, thereby effecting movement of the arm 19. When the float reaches a predetermined position, such as that caused by the level of liquid in the tank rising to within a few inches below the top of the tank, the switch 21 will be opened, thereby breaking the circuit to and deenergizing the supply of air from the valve 52 to the valve 56 which controls the pump P. With the air supply to control 56 terminated, the spring returned valve 56 returns control shaft 25 to a neutral position and the pump ceases to operate. At the same time, deenergization of solenoid 43 operates valve 42 to shut off the air supply line 44 and exhaust the air in line 32 via the exhaust opening 45 to permit valve FV to close.

Stopping of the operation of the pump P is automatic and is not subject to possible vehicle operator inadvertence, or incapacity.

By the time the float control switch 21 is opened, the tank 4 will be close to full, but there still will be some space within the tank for additional liquid, and the conduit 12 will still be full of oil which must not be released to the ground. Thus, at this time, the vehicle operator moves the control toggle lever 37 to the contact 40 position which has the effect of energizing solenoid 43 and opening fire valve FV while, at the same time, operating control 52 to reposition valve 56 to again move control rod 25 to a position in which the pump drives forwardly. In this way, the operator may, after closing reservoir valve 17, pump the contents of removable conduit 12 to the remaining free space in the top of tank 4, after which control toggle 37 can be switched to the "off" position at contact 39. In the "off" position, the solenoid 43 is deenergized and fire valve FV closes. Similarly the pump P control rod 25 is spring returned to neutral position and the pump is rendered inoperative. The operator can now uncouple the conduit 12 at coupling 13.

To unload tank 4 the selector toggle switch 37 is moved to the terminal 40 manual position, which again energizes solenoid 43 to open fire valve FV via air pressure from line 32. The selector switch 47, which just prior to this has been moved to the unload position at contact 50, connects the circuit to energize solenoid 53 and supply air to control 56 via line **53*a* (while air is exhausted through line 51*a*) to move control rod 25** from its neutral position to a pump reversing position.

In this condition of the circuit, the pump P is operated to unload oil from the tank 4 to the conduit 12, which has previously been connected to load an aboveground storage tank. During the unloading operation and with fire valve FV in an open position, the vapor valve VV is also in open position and connected by hose h to the upper end of the above ground storage reservoir.

The system described, preserves the safety features inherent in my previously issued U.S. Pat. No. 4,091,846, while, at the same time, providing for an unloading operation under conditions which provide also for the safe elimination of vapors from tank 4 to a closed reservoir. In the unloading operation, the pump P is simply operated sufficiently to completely clear lines 10 and 12 of oil prior to switching selector arm 47 to the "off" position.

Figure 5:
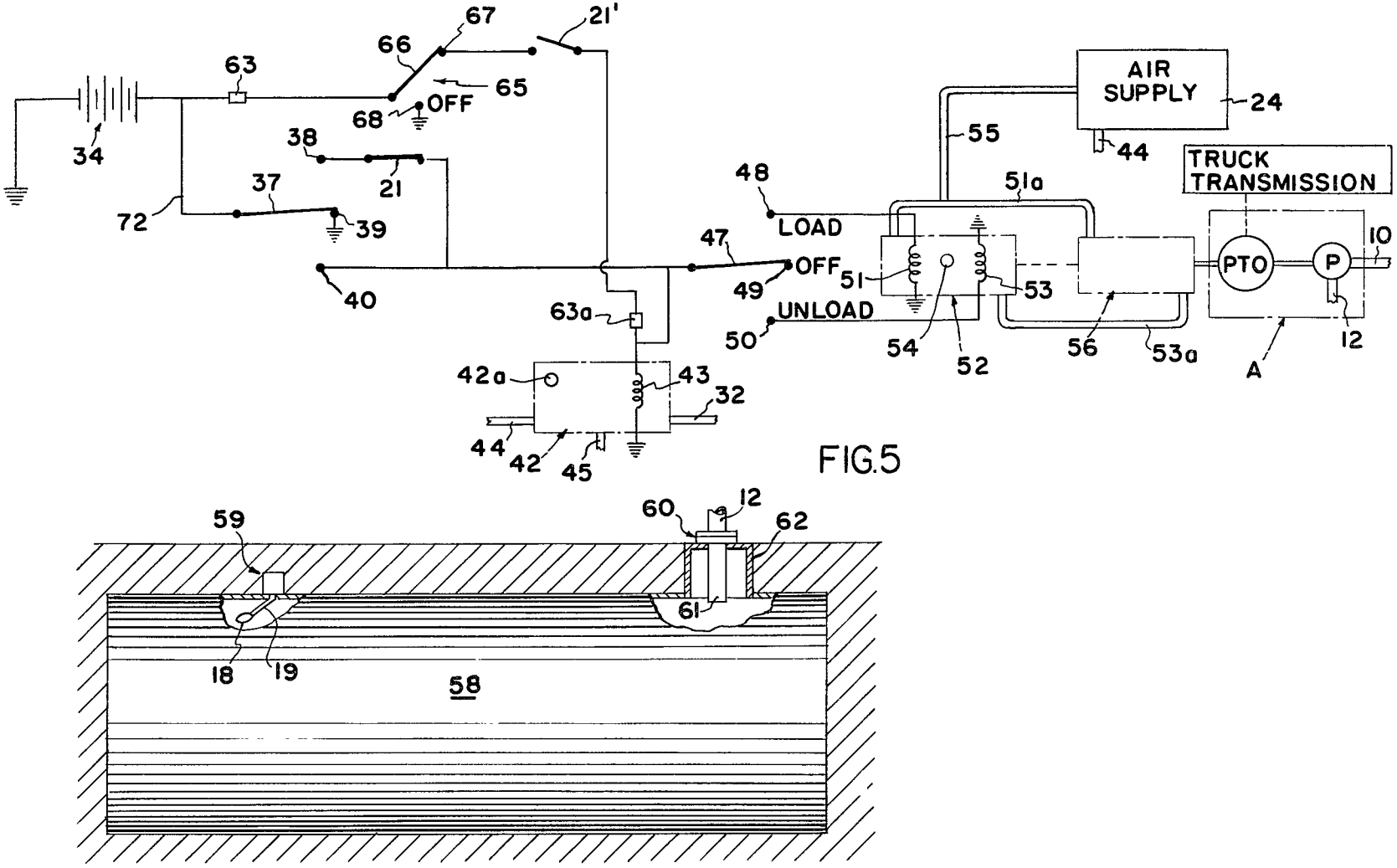
FIG. 5 is still another schematic electrical diagram illustrating a further embodiment of the invention in which the "fire" valve is controlled by the unloading system.

In FIG. 5, an alternate form of unloading system is illustrated, in which the liquid is being gravity unloaded to an undergound storage tank denominated 58 in FIG. 5. It has a float operated sensor generally designated 59 which is identical to the sensor used in tank 4. Sensor 59, therefore, similarly includes the float 18 and the arm 19, and has the switch 21 as previously. In this system, the truck conduit 12 is shown as coupled as at 60 to the underground tank fill pipe 61, which is surrounded by a protective housing 62. In the electrical circuit illustrated, the truck battery is similarly designated 34, and provides a source of power, and a plug box is provided on the vehicle at 63 into which the circuit line 64, provided at the site of the underground storage tank, can be plugged to obtain a source of power. The opposite end of circuit line 64 is also plugged into a vehicle mounted plug at 63*a*. Connected in circuit line 64, is a two-way switch generally designated 65, and the switch includes a movable toggle arm 66 capable of making contact with either contacts 67 or contacts 68. Contacts 67 are in series with the sensor switch 21' and the contacts 68 simply indicate the "off" position. The valve 42, which receives air from the truck air supply via line 44 in the same manner as in the FIG. 3 embodiment and operates in exactly the same manner as in the FIG. 3 embodiment has been provided with the same numerals as previously. It includes the solenoid 43, the manual override knob 42*a*, the exhaust line 45, and the line 32 which is provided to furnish air to open the fire valve FV shown previously in FIG. 4. The remainder of the control circuit remains the same, has been identically numeraled, and operates in the manner previously described.

In operation, and assuming the tank 4 is to be gravity unloaded to the underground storage tank 58, it is merely necessary for the operator to plug line 64 into plug boxes 63 and 63*a* to provide power to the switch 21' of underground tank sensor 59. To accomplish the gravity unload, the two-way switch toggle arm 66 is placed in the automatic position in which contacts 67 are engaged, and the vehicle mounted toggle switch arm 37 is placed in the "off" position in contact with contacts 39. Normally closed switch 21' will maintain solenoid 43 energized until the tank 58 is filled, so that the vehicle fire valve FV is forced upon via air pressure from lines 44 and 32, and oil can flow from tank 4 through conduits 10 and 12 to the underground tank pipe 61. At the same time, the vapor valve VV on the vehicle tank 4 will be opened. The hose h will be detachably connected to the upper end of underground storage tank 58 to release vapors from the top of tank 4 to the tank 58. When the power take off PTO is in neutral position, its gears are not in mesh and the pump is free to turn under the influence of the gravity induced flow of oil. When the unloading operation is completed switch arm 66 is moved to the "off" position to deenergize solenoid 43 and remove the air pressure holding the loading valve 27 and vapor valve 27' open. If desired, a separate hose can be detachably connected to fire valve FV and fill pipe 61 to bypass the pump.

To permit the truck to move again to a loading station for refilling, line 64 is unplugged at 63 and 63*a*. When the truck is then ready to be loaded once again, switch arm 37 is moved to the contact 38 position. With the present system, top loading via the dome covers, which can be dangerous for personnel who must climb to the top of tank 4, is eliminated because with the automatic shut off control there is no need to ever open dome covers for loading. Fire and spillage problems are obviated in the system described. The line 64 can be used in connection with an aboveground storage system where a sensor 59 is in position as well.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. In a liquid transfer system for transferring liquid from a storage reservoir to a mobile truck-mounted transport tank via a conduit leading from the reservoir to the tank and a flow control valve operable to shut off or permit flow through the conduit from the reservoir including:

(a) a mobile truck with a transport tank,
(b) a pump in communication with the conduit,
(c) an energy source,
(d) drive means for driving said pump,
(e) adjustable switching circuitry connected with said energy source for controlling the drive means and pump,
(f) a sensor, for determining when the liquid level in said tank is at a predetermined level, connected with said circuitry,
(g) switching means, connected in said circuitry, in one position causing the drive means and pump to operate only so long as the sensor indicates the level in the tank is below said predetermined level and then disabling the drive means and pump, and in a second position selectively permitting the drive means and pump to operate even when the level in the transport tank is at or above said predetermined level;

the improvement wherein:

normally closed valve means at the transport tank is provided for communicating the pump and conduit with the transport tank when the valve means is opened; and means is provided for automatically opening said normally closed valve means when said float is at said level below said predetermined higher level which also automatically opens said normally closed valve means when said switching means is in said second position.

2. The improvement of claim 1 wherein an air pressure powered member is connected to operate said normally closed valve means and a control, connected in said circuitry and operated by said switching means, has connection with a source of air under pressure to enable or disable said air pressure powered member.

3. The improvement of claim 2 wherein spring means normally urges said normally closed valve means to closed position.

4. The improvement of claim 1 wherein said drive means can selectively drive said pump in either direction; a second switching means, connected in said circuitry, controls said drive means to drive the pump forwardly to load liquid to the tank or reversely to unload liquid from the tank; the second switching means in one position permitting the pump to drive forwardly and be disabled when the sensor reaches a predetermined level and in another position providing for driving of the pump reversely to unload when the first switching means is in said second position.

5. The improvement of claim 4 wherein an air pressure operated control connected with a source of air under pressure is incorporated with said drive means and pump to transmit the drive from said drive means in a manner to selectively drive said pump forwardly or reversely, and an actuator device in circuit with said second switching means operates said control to drive the pump forwardly or reversely in accordance with the position of said second switching means.

6. The improvement of claim 2 in which a normally closed vapor vent valve is provided at the upper end of said tank and said air pressure powered member is also connected to open said vapor vent valve when the normally closed tank valve means is opened.

7. In a liquid transfer system for transferring liquid between a storage tank and a mobile truck-mounted transport tank which are connected by a conduit system, including:

(a) a mobile truck with a transport tank,
(b) a normally closed transport tank loading valve in connection with the conduit system,
(c) an energy source,
(d) actuator means for opening said valve,
(e) circuitry on the truck connected with said energy source for operating the actuator means, and
(f) a sensor, for determining when the liquid level in one of said tanks is at a predetermined level, connected with said circuitry, the improvements wherein:

(g) switch elements, connected with said circuitry, in certain positions cause the actuator means to open the normally closed tank loading valve only so long as the sensor indicates the level in the tank is below said predetermined level and then disable the actuator means.

8. The system of claim 7 wherein the sensor is provided in said storage tank and a detachable circuit having said sensor connected therein is provided at the storage tank for detachable connection with said truck circuitry.

9. The system of claim 8 wherein the energy source is the truck battery.

10. In a liquid transfer system for transferring liquid from a storage reservoir to a mobile truck-mounted transport tank via a conduit leading from the reservoir to the tank and a flow control valve operable to shut off or permit flow through the conduit from the reservoir, including:

(a) a mobile truck with a transport tank,
(b) a pump in communication with the conduit,
(c) an energy source,
(d) drive means for driving said pump,
(e) circuitry connected with said energy source for controlling the drive means and pump,
(f) a sensor, for determining when the liquid level in said tank is at a predetermined level, connected with said circuitry,
(g) first switch elements, connected in said circuitry, in certain positions causing the drive means and pump to operate only so long as the sensor indicates the level in the tank is below said predetermined level and then disabling the drive means and pump,
(h) means provided in conjunction with said first switch elements to additionally selectively permit the drive means and pump to operate even when the level in the transport tank is at or above said predetermined level;

the improvement wherein said drive means can selectively drive said pump in either forward or reverse directions; and a second set of switch elements connected in said circuitry, is provided to control said drive means to drive the pump forwardly to load liquid to the tank or reversely to unload liquid from the tank; the second set of switch elements in one position permitting the pump to drive forwardly and be disabled when the sensor indicates a certain liquid level has been reached and in another position providing for driving of the pump reversely to unload when the first switch elements are in other than said certain positions.

11. The system of claim 10 wherein normally closed valve means at the tank is provided for communicating the pump and conduit with the tank; and means is provided for automatically opening said normally closed valve means when said float is at said level below said predetermined higher level which also automatically opens said normally closed valve means in conjunction with the operation of said means for additionally selectively permitting the drive means and pump to operate even when the level in the transport tank is at or above said predetermined level.

12. In a liquid transfer system for transferring liquid from a storage reservoir to a mobile truck-mounted transport tank via a conduit leading from the reservoir to the tank and a flow control valve operable to shut off or permit flow through the conduit from the reservoir including:

(a) a mobile truck with a transport tank,
(b) a pump in communication with the conduit,
(c) an energy source,
(d) circuitry connected with said energy source for controlling the pump,
(e) a sensor, for determining when the liquid level in said tank is at a predetermined level, connected with said circuitry,
(f) first switch elements, connected in said circuitry to cause the pump to operate only so long as the sensor indicates the level in the tank is below said predetermined level and then disable the pump,
(g) means provided in conjunction with said switch elements to additionally selectively permit the pump to operate even when the level in the transport tank is at or above said predetermined level,
(h) a valve at the tank for selectively permitting or preventing communication of the conduit with the tank, and
(i) an actuator system for opening and closing the valve, connected in the circuitry;

the improvement wherein means is provided to selectively drive said pump in either forward or reverse direction; and second switch elements, connected in said circuitry, are provided to control said pump to drive the pump forwardly to load liquid to the tank or reversely to unload liquid from the tank; the second switch elements in one position being in series with said first switch elements to permit the pump to drive forwardly and be disabled when the sensor indicates a certain liquid level has been reached and in another position providing for driving of the pump reversely to unload; and the actuator system being connected to maintain the valve open when the pump is driven forwardly before the sensor indicates the certain level has been reached or after when the level is above the said level, and when the pump is driven reversely, but otherwise operating to close the valve.

* * * * *